US008567219B2

(12) United States Patent
Choi et al.

(10) Patent No.: US 8,567,219 B2
(45) Date of Patent: Oct. 29, 2013

(54) WASHING MACHINE

(75) Inventors: Yeon Sik Choi, Changwon-si (KR); Chang Woo Son, Changwon-si (KR); Dong Geun Lee, Changwon-si (KR); Dong Hyun Kim, Changwon-si (KR); Heung Jae Kim, Changwon-si (KR); Ju Han Yoon, Changwon-si (KR); Young Bok Son, Changwon-si (KR); Sang Hun Bae, Changwon-si (KR); Chul Jin Choi, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1154 days.

(21) Appl. No.: 12/232,821

(22) Filed: Sep. 24, 2008

(65) Prior Publication Data

US 2009/0120140 A1 May 14, 2009

(30) Foreign Application Priority Data

Nov. 1, 2007 (KR) ..... 10-2007-0110949

(51) Int. Cl.
*D06F 39/08* (2006.01)
*D06F 58/10* (2006.01)

(52) U.S. Cl.
USPC ..... 68/5 C; 68/13 R; 239/104; 239/288; 239/600; 222/567; 222/569; 222/572

(58) Field of Classification Search
USPC ..... 68/5 C, 12.08, 15, 16, 13 R; 134/105, 134/108; 223/51; 239/17, 104–123, 239/266–269, 653, 689, 697–698, 16, 289, 239/589, 600, 103, 587; 222/567–574; 4/596–597, 609
See application file for complete search history.

(56) References Cited

U.S. PATENT DOCUMENTS

| | | | | | |
|---|---|---|---|---|---|
| 1,349,775 | A | * | 8/1920 | Lyman et al. | 239/29 |
| 1,828,463 | A | * | 10/1931 | Hammers | 239/103 |
| 1,972,366 | A | * | 9/1934 | Todd et al. | 239/31 |
| 2,256,080 | A | * | 9/1941 | Eweryd et al. | 239/103 |
| 2,966,052 | A | * | 12/1960 | Syles | 68/58 |
| 3,122,322 | A | * | 2/1964 | Niemann et al. | 239/130 |
| 3,355,107 | A | * | 11/1967 | Hansel | 239/29 |
| 3,515,348 | A | * | 6/1970 | Coffman, Jr. | 239/103 |
| 3,597,851 | A | * | 8/1971 | Arendt et al. | 34/60 |
| 3,749,424 | A | * | 7/1973 | Greene | 285/139.1 |
| 4,207,683 | A | * | 6/1980 | Horton | 34/60 |
| 4,379,097 | A | * | 4/1983 | Leggett | 261/78.2 |
| 4,489,574 | A | * | 12/1984 | Spendel | 68/16 |

(Continued)

FOREIGN PATENT DOCUMENTS

| | | | |
|---|---|---|---|
| DE | 10 2007 007 354 | A1 | 10/2007 |
| KR | 2004015957 | A * | 2/2004 |

(Continued)

*Primary Examiner* — Michael Barr
*Assistant Examiner* — Kevin G Lee
(74) *Attorney, Agent, or Firm* — McKenna Long & Aldridge LLP

(57) ABSTRACT

The present invention relates to a washing machine, and the washing machine includes a drum rotatably installed in a cabinet, an air heater for heating air, to supply hot air to the drum, a steam generator for generating steam, and supply the steam to the drum, and a water supply unit including a nozzle for spraying the steam generated by the steam generator to an interior of the drum, and a nozzle holder having a coupler at a rear surface of the nozzle holder, to separably mount the nozzle at a position adjacent to the drum.

13 Claims, 11 Drawing Sheets

(56) References Cited

U.S. PATENT DOCUMENTS

| | | | | |
|---|---|---|---|---|
| 4,562,964 | A * | 1/1986 | Diamond | 239/288.5 |
| 4,926,946 | A * | 5/1990 | Polan | 169/37 |
| 5,920,925 | A * | 7/1999 | Dongo | 4/541.6 |
| 5,927,892 | A * | 7/1999 | Teh-Tsung | 403/259 |
| 6,444,907 | B1 * | 9/2002 | Kiely | 174/657 |
| 6,555,750 | B2 * | 4/2003 | Kiely | 174/657 |
| 6,691,536 | B2 * | 2/2004 | Severns et al. | 68/12.27 |
| 6,737,584 | B2 * | 5/2004 | Kiely | 174/656 |
| 6,767,032 | B1 * | 7/2004 | Gretz | 285/151.1 |
| 6,904,626 | B1 * | 6/2005 | Hester et al. | 4/541.6 |
| 7,043,775 | B2 * | 5/2006 | Holtsnider et al. | 4/541.6 |
| 7,121,589 | B2 * | 10/2006 | Hawkinson et al. | 285/139.2 |
| 7,325,330 | B2 * | 2/2008 | Kim et al. | 34/407 |
| 7,429,064 | B2 * | 9/2008 | Topolsek et al. | 285/151.1 |
| 7,624,813 | B2 * | 12/2009 | Ma | 169/37 |
| 7,757,964 | B2 * | 7/2010 | Hansson | 239/110 |
| 7,841,219 | B2 * | 11/2010 | Wong et al. | 68/15 |
| 7,870,762 | B2 * | 1/2011 | Park et al. | 68/5 R |
| 2003/0066657 | A1 * | 4/2003 | Sundholm | 169/37 |
| 2005/0034488 | A1 * | 2/2005 | Oh et al. | 68/5 C |
| 2005/0132503 | A1 * | 6/2005 | Yang et al. | 8/149.3 |
| 2005/0223504 | A1 * | 10/2005 | Lee et al. | 8/158 |
| 2005/0251924 | A1 * | 11/2005 | Du Val et al. | 8/115.51 |
| 2006/0101586 | A1 * | 5/2006 | Park et al. | 8/149 |
| 2007/0028398 | A1 * | 2/2007 | Kwon et al. | 8/158 |
| 2007/0130697 | A1 * | 6/2007 | Oh et al. | 8/149.3 |
| 2007/0295037 | A1 * | 12/2007 | Blomberg et al. | 68/17 R |
| 2009/0126099 | A1 * | 5/2009 | Holtsnider | 4/541.6 |
| 2009/0272003 | A1 * | 11/2009 | Dalton et al. | 34/329 |
| 2010/0058610 | A1 * | 3/2010 | Kim et al. | 34/474 |
| 2010/0206016 | A1 * | 8/2010 | Bae et al. | 68/5 C |
| 2011/0100070 | A1 * | 5/2011 | Kim et al. | 68/200 |

FOREIGN PATENT DOCUMENTS

| | | | |
|---|---|---|---|
| KR | 10-0696423 | B1 | 3/2007 |
| KR | 10-0740836 | B1 | 7/2007 |
| KR | 10-0797513 | B1 | 1/2008 |
| WO | WO 2007055510 | A1 * | 5/2007 |

* cited by examiner

WASHING MACHINE

This application claims the benefit of Korean Patent Application No. 10-2007-0110949, filed on Nov. 1, 2007, which, is hereby incorporated by reference as if fully set forth herein.

BACKGROUND OF THE INVENTION

1. Field of the Invention

The present invention relates to a washing machine, and more particularly to a laundry dryer capable of uniformly spraying steam onto clothes, and preventing the clothes from being damaged during an operation of the laundry dryer.

2. Discussion of the Related Art

Typically, a laundry dryer is a home appliance used to dry laundry, mainly clothes, completely washed, using hot air. Generally, such a laundry dryer includes a drum for accommodating laundry to be dried therein, and a drive source for driving the drum, a heater for heating air introduced into the drum, and a blower unit for sucking air into the drum or outwardly discharging air from the drum.

Laundry dryers may be classified into an electric type and a gas type in accordance with the type of the system for heating air, namely, the type of the heater. The electric type laundry dryer heats air, using heat generated from an electrical resistance. On the other hand, the gas type laundry dryer heats air, using heat generated in accordance with the combustion of gas. Laundry dryers may also be classified into an exhaustion type and a condensation type. In the condensation type laundry dryer, air, which has become humid after being heat-exchanged with laundry to be dried, is circulated without being outwardly discharged. The air is heat-exchanged with ambient air through a separate condenser. In accordance with this heat exchange, condensed water is generated, and is then outwardly discharged. In the exhaustion type laundry dryer, air, which has become humid after being heat-exchanged with laundry to be dried, is directly discharged to the outside of the laundry dryer. Laundry dryers may also be classified into a top loading type and a front loading type in accordance with the laundry loading type. In the top loading type laundry dryer, laundry to be dried is loaded into the laundry dryer through the top of the laundry dryer. On the other hand, in the front loading type laundry dryer, laundry to be dried is loaded into the laundry dryer through the front side of the laundry dryer.

Meanwhile, conventional laundry dryers as mentioned above have the following problems.

Typically, in a laundry dryer, laundry spin-dried after being completely washed is loaded so that it can be dried. In this case, the laundry, which has been washed using water, has creases due to the principle of the water washing. In the drying procedure carried out in the laundry dryer, however, the creases cannot be completely removed. In order to remove the creases still present on objects, such as laundry, completely dried in conventional drying machines, it is necessary to perform ironing.

Where clothes other than laundry completely washed are stored or used in a typical manner, creases, rumples, or holds (hereinafter, generally referred to as "creases") may be formed at the clothes. To this end, it has been required to develop an apparatus capable of conveniently removing creases generated during the storage or use of clothes.

SUMMARY OF THE INVENTION

Accordingly, the present invention is directed to a washing machine that substantially obviates one or more problems due to limitations and disadvantages of the related art.

An object of the present invention is to provide a washing machine capable of avoiding the formation of creases on clothes, etc. and/or removing creases formed on clothes, etc.

Another object of the present invention is to provide a washing machine capable of preventing clothes from being damaged when the clothes are dried.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing machine comprises: a drum rotatably installed in a cabinet; an air heater for heating air, to supply hot air to the drum; a steam generator for generating steam, and supply the steam to the drum; and a water supply unit comprising a nozzle for spraying the steam generated by the steam generator to an interior of the drum, and a nozzle holder having a coupler at a rear surface of the nozzle holder, to separably mount the nozzle at a position adjacent to the drum.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts. For the convenience of description, the following description will be given in conjunction with the case in which a washing machine, particularly a laundry dryer according to the present invention is of a top loading, electric, and condensation type. However, the present invention is not limited to such a type. For example, the present invention may be applied to a front loading, gas, and condensation type dryer.

Figure 1:
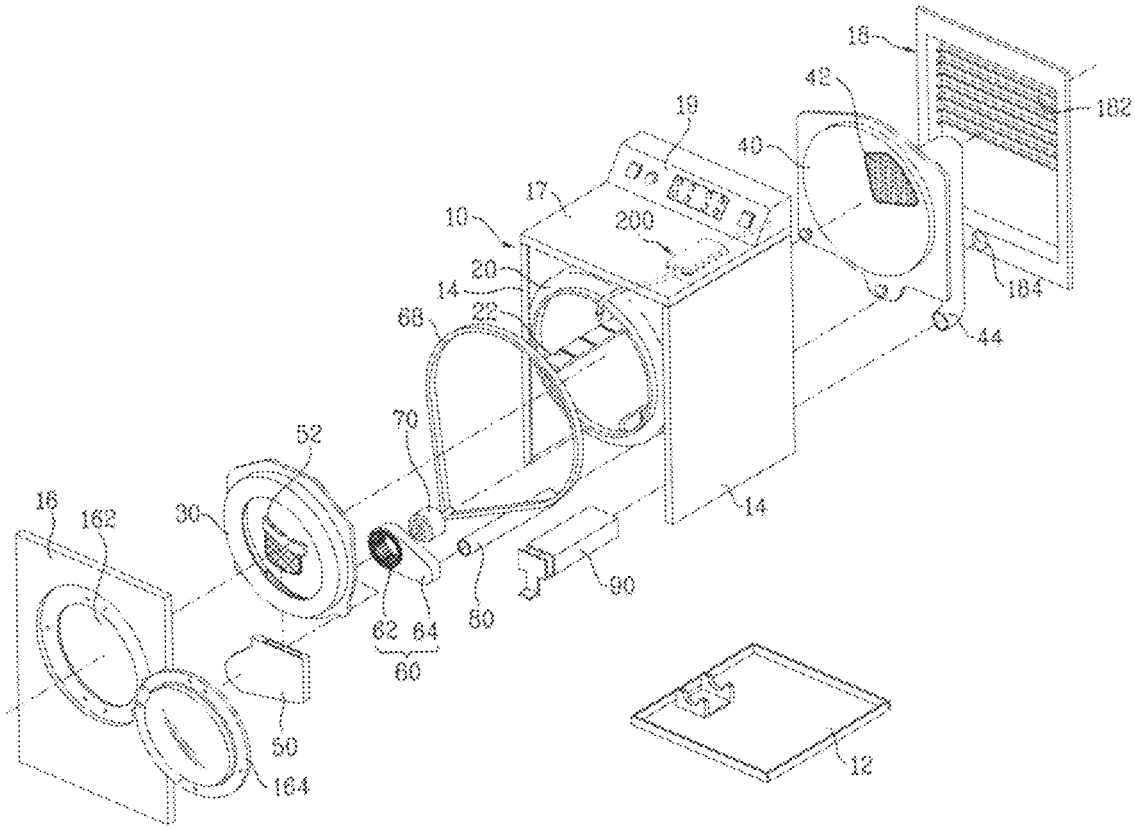
FIG. 1 is an exploded perspective view illustrating an exploded state of a washing machine according to a preferred embodiment of the present invention.
Figure 2:
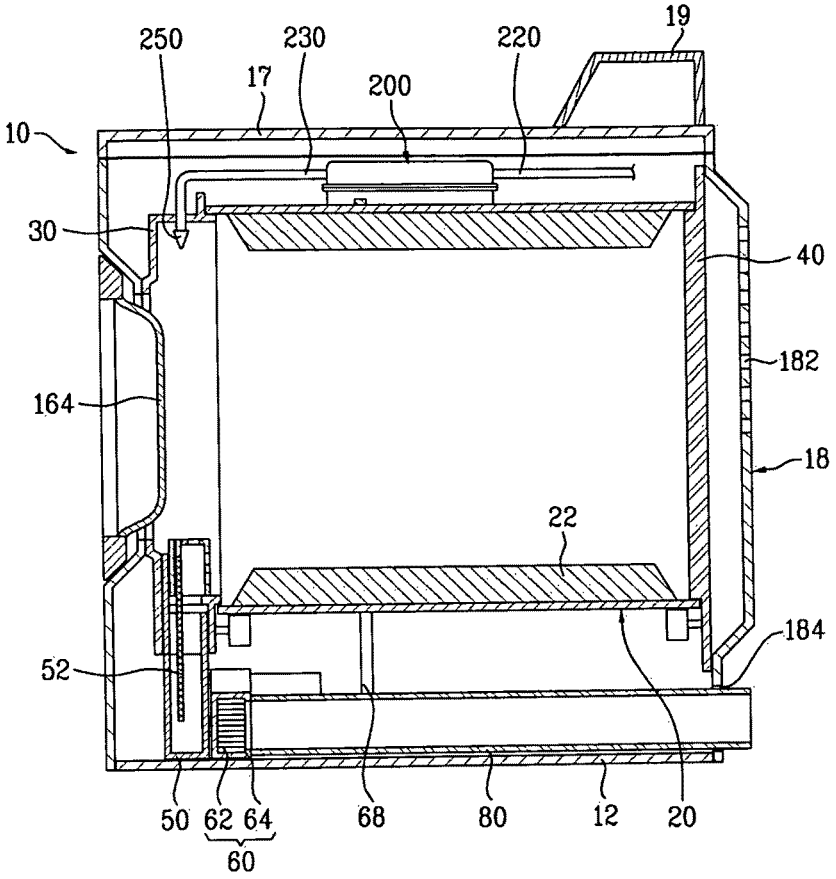
FIG. 2 is a longitudinal sectional view corresponding to FIG. 1.

FIG. 1 is an exploded perspective view illustrating an exploded state of a washing machine according to a preferred embodiment of the present invention. FIG. 2 is a longitudinal sectional view corresponding to FIG. 1.

Hereinafter, the washing machine according to the illustrated embodiment of the present invention will be described with reference to FIGS. 1 and 2.

A cabinet 10 forms an outer structure of the washing machine, more particularly laundry dryer according to the present invention. Various constituent elements of the laundry dryer are arranged in the interior of the cabinet 10. That is, a rotatable drum 20, and a motor 70 and a belt 68, which are adapted to drive the drum 20, are installed in the cabinet 10. An air heater 90 is arranged in the cabinet 10 at a desired position, to heat air, and thus to generate hot air. A hot air supply duct 44 is also arranged in the cabinet 10, to supply the hot air generated by the air heater 90 to the drum 20. In the cabinet 10, an exhaust duct 80 for exhausting humid air heat-exchanged with objects to be dried in the drum 20, and a blower unit 60 for sucking the humid air are also arranged. Meanwhile, a water generator is arranged in the cabinet 10 at a desired position, to generate water and supply the water to the drum 20.

Although an indirect drive type, in which the motor 70 and belt 68 are used to rotate the drum 20, is illustrated and described in this embodiment, the present invention is not limited thereto. That is, a direct drive type, in which a motor is directly connected to a rear wall of the drum 20, to directly rotate the drum 20, may be applied to the present invention.

Hereinafter, the above-described constituent elements will be described in more detail.

The cabinet 10, which forms the outer structure of the laundry dryer, includes a base 12 forming a bottom wall, a pair of side covers 14 extending vertically from the base 12, a front cover 16 mounted to the front ends of the side covers 14, a rear cover 18 mounted to the rear ends of the side covers 14, and a top cover 17 disposed on the upper ends of the side covers 14. A control panel 19, which includes various operating switches or the like, is arranged on the top cover 17 or front cover 16. A door 164 is mounted to the front cover 16. A louver 182 is provided at the rear cover 18, to introduce ambient air into the cabinet 10. An exhaust hole 184 is also provided at the rear cover 18, as a passage for finally discharging air from the drum 20 to the outside of the drum 20.

The interior of the drum 20 functions as a drying chamber, in which a drying operation is carried out. It is preferred that a lift 22 be installed in the drum 20, to drop laundry after raising the laundry such that the laundry is turned over, and thus to achieve an enhancement in drying efficiency.

Meanwhile, a front supporter 30 and a rear supporter 40 are installed between the drum 20 and the cabinet 10, namely, between the drum 20 and the front cover 16 and between the drum 20 and the rear cover 18, respectively. The drum 20 is rotatably installed between the front supporter 30 and the rear supporter 40. Sealing members (not shown) are fitted between the front supporter 30 and the drum 20 and between the rear supporter 40 and the drum 20, respectively, to prevent water leakage. That is, the front supporter 30 and rear supporter 40 close the front and rear ends of the drum 20, to define the drying chamber in the drum 20. The front supporter 30 and rear supporter 40 also function to support the front and rear ends of the drum 20.

An opening is formed through the front supporter 30, to communicate the drum 20 with the outside of the laundry dryer. The opening is selectively opened or closed by the door 164. A lint duct 50, which is a passage for outwardly discharging air from the drum 20, is connected to the front supporter 30. A lint filter 52 is installed in the lint duct 50.

One side of the blower unit fan 60 is connected to the lint duct 50. The other side of the blower unit 60 is connected to the exhaust duct 80. The exhaust duct 80 communicates with an exhaust hole 184 provided at the rear cover 18.

Accordingly, when the blower unit 60 operates, air present in the drum 20 is exhausted from the drum 20 via the lint duct 50, exhaust duct 80, and exhaust hole 184. During this operation, foreign matter such as lint is filtered out by the lint filter 52. Typically, the blower unit 60 includes a blower 62, and a blower housing 64. Typically, the blower 62 is connected to the motor 70, which drives the drum 20.

An opening 42, which is constituted by a plurality of through holes, is formed through the rear supporter 40. A hot air supply duct 44 is connected to the opening 42. The hot air supply duct 44 communicates with the drum 20, to function as a passage for supplying hot air to the drum 20. To this end, the air heater 90 is installed at a certain position in the hot air supply duct 44.

Meanwhile, an water generator is provided in the cabinet 10 to supply water to the drum 20.

For example, the water generator may include a pressing means to press the water supplied to the drum, such that a mist is supplied to the drum. In this case, the pressing means may be configured of an auxiliary pump or configured to be directly connected with an outside water tap to press the water to a predetermined pressure by the water pressure of the water tap. In case that the water is supplied by the predetermined pressure, the water may be sprayed into the drum 20 in a mist shape by a nozzle provided in an water supply unit.

In the embodiments of the present invention, a steam generator 200 may be configured as the water supply unit. Here, the steam generator 200 generates steam and supplies the steam to the inside the drum 20. Next, the steam generator will be described in reference to the drawings.

Figure 3:
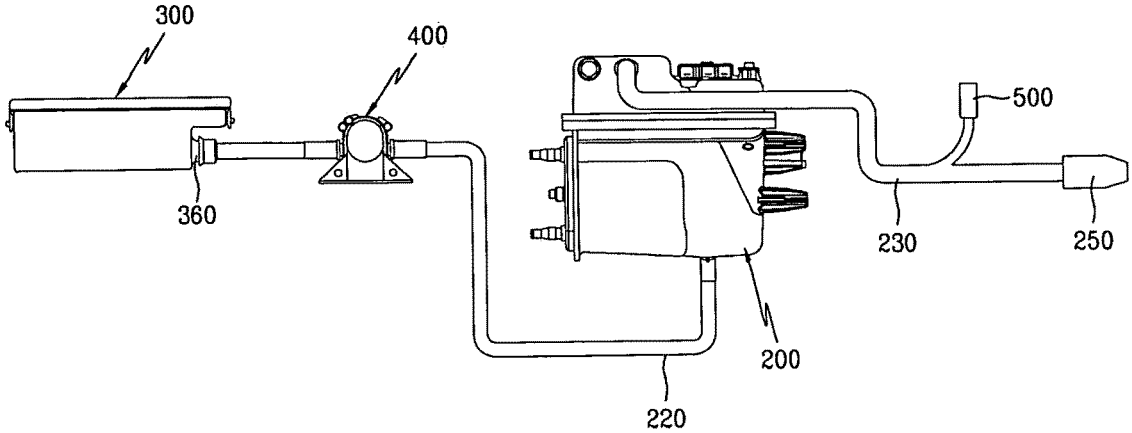
FIG. 3 is a schematic view illustrating a steam generator included in a washing machine according to an embodiment of the present invention.

FIG. 3 is a schematic view illustrating the steam generator shown in FIG. 1. Hereinafter, the steam generator 200 will be described in detail with reference to FIG. 3.

The steam generator 200 includes a water tank 210 for containing water therein, a heater 240 mounted in the water tank 210, a water level sensor 260 for measuring the water level of the steam generator 200, and a temperature sensor 270 for measuring the temperature of the steam generator 200.

A water supply hose 220 is connected to one side of the steam generator 200, to supply water to the steam generator 200. A steam hose 230 is connected to the other side of the steam generator 200, to discharge steam from the steam generator 200. Preferably, a water supply unit 250 is arranged at an end of the steam hose 230 opposite to the steam generator 200, to spray steam.

Although the steam generator 200 has been illustrated and described as being of a system in which a certain amount of water contained in the water tank 210, which has a certain size, is heated by the heater 240, to generate steam (hereinafter, referred to as a "heating system", for the convenience of description), the present invention is not limited thereto. In the present invention, any steam generator can be used, as long as it can generate steam. For example, a system, in which a heater is installed around a water supply hose, through which water flows, namely, a system heating water under the condition in which the water is not contained in any space (hereinafter, referred to as a "pipe heating system", for the convenience of description), may be used.

In accordance with this embodiment, the water supply source, which supplies water to the steam generator 200, may be separably installed. Although not shown, the water supply source may be fixedly installed. Although the water supply source may be a city water tap, as in the previous embodiment, there is a difficulty in connecting the steam generator 200 to the city water tap. This is because no water is used in a typical laundry dryer. That is, when the city water tap is used as a water supply source, it is necessary to additionally install various devices associated with the city water tap. Therefore, there is a convenience in the case in which a detachable water supply source 300 is used in such a manner that water is supplied to the water supply source 300 in a separated state of the water supply source 300, and the water-filled water supply source 300 is then connected to the water supply line of the steam generator 200, namely, the water supply hose 220, as in the present embodiment.

Preferably, a pump 400 may be arranged between the water supply source 300 and the steam generator 200. More preferably, the pump 400 is rotatable in normal and reverse directions, not only to supply water to the steam generator 200, but also to recover residual water from the steam generator 200, if necessary. The reason why residual water is recovered from the steam generator 200 is that, when the steam generator 200 is not used for a prolonged period of time, the residual water may cause damage to the heater of the steam generator 200, or may be used in a decomposed state.

Figure 4:
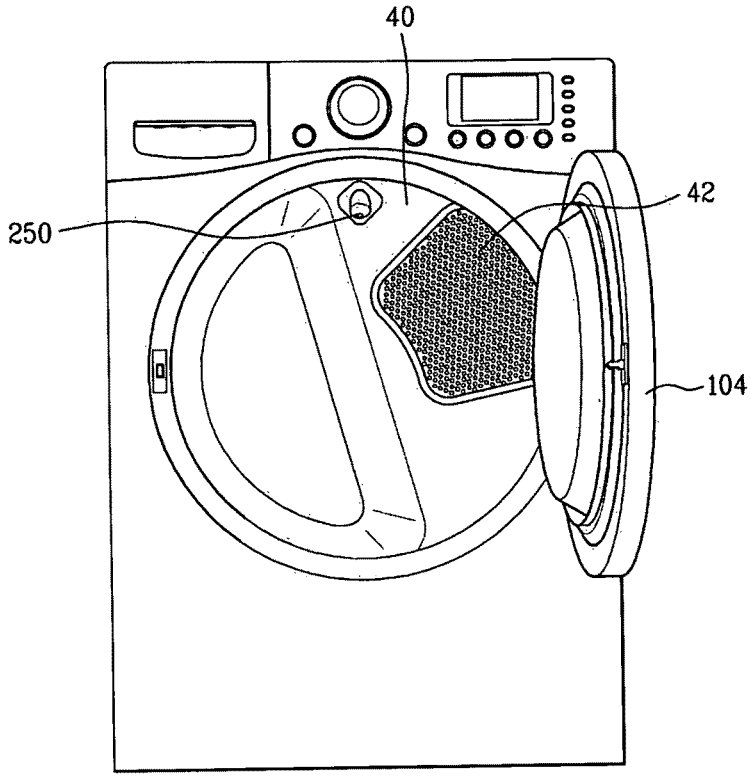
FIG. 4 is a front view illustrating an installed state of a water supply unit shown in FIG. 3.

FIG. 4 is a front view illustrating a state in which the water supply unit adapted to spray steam is installed in the laundry dryer according to the present invention.

Referring to FIG. 4, the water supply unit 250 may be separably installed adjacent to the drum ("20" in FIG. 1). Preferably, the water supply unit 250 is mounted to an upper portion of the rear supporter 40 arranged at the rear side of the drum 20. More preferably, the water supply unit 250 is arranged to be directed toward the central portion of the drum 20 such that steam is directed to the central portion of the drum 20. When the water supply unit 250 is arranged at the upper portion of the rear supporter 40 adjacent to the drum 20 such that it is directed to the central portion of the drum 20, steam emerging from the water supply unit 250 can be sprayed toward the central portion of the drum 20. Thus, steam can be uniformly sprayed onto clothes, etc. received in the drum 20.

It is also preferred that the water supply unit 250 be arranged adjacent to the opening 42, which supplies hot air to the drum 20, in order to enable steam to be sprayed from the rear side of the drum 20 toward the front side of the drum 20. Typically, air is introduced into the drum 20 via the opening 42 formed through the rear supporter 40 arranged at the rear side of the drum 20, and is then discharged from the drum 20 to the lint duct 50 arranged beneath a door 104 at the front side of the cabinet ("10" in FIG. 1). Thus, an air flow path, which extends substantially from the opening 42 to the lint duct 50, is defined. Accordingly, when the water supply unit 250 is installed adjacent to the opening 42, and sprays steam toward a region arranged beneath the door 104 at the front side of the cabinet 10, the sprayed steam flows smoothly along the air flow path, and thus is uniformly attached or absorbed in the clothes contained in the drum 20.

A test was conducted to compare the case, in which the water supply unit is installed at the rear side of the cabinet adjacent to the drum, as described above, with the case, in which the water supply unit is installed at a position different from that of the former case, in terms of the crease removal effect obtained in accordance with the spray of steam. In detail, in this test, the case, in which the water supply unit is installed at an upper portion of the front side of the drum, and the case, in which the water supply unit is installed at an upper portion of the rear side of the drum, in terms of the crease removal effect obtained in accordance with the spray of steam.

Figure 5:
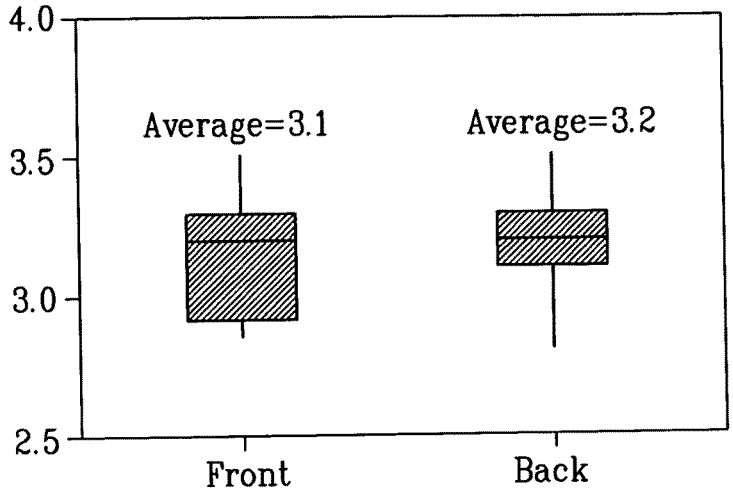
FIG. 5 is a graph depicting crease removal effects depending on the installation position of the water supply unit.

FIG. 5 is a graph depicting the results of the above-described test representing the effect of removing creases from clothes, which depends on the installation position of the water supply unit. In the test, the crease removal effect comparison was conducted by repeating a drying process, five times, for each nozzle position. The drying process includes the procedures of loading 4 sets of clothes made of the same material into the drum, spraying steam onto the clothes for 13 minutes, and supplying hot air generated by the air heater ("90" in FIG. 1) to the drum for 10 minutes, to dry the clothes.

Meanwhile, the crease removal effect was represented by a value obtained by comparing the completely-tested clothes with a sample prescribed by American Association of Textile Chemists and Colorists (AATCC). That is, AATCC prescribes values of 1 to 5 for samples exhibiting different degrees of creases. Here, the value of 1 represents a maximum degree of creases, whereas the value of 5 represents a minimum degree of creases. In the above-described test, accordingly, the completely-dried clothes were compared with the samples, to represent the degree of creases of the clothes by a corresponding one of the prescribed values.

Referring to the graph of FIG. 5, it can be seen that a crease removal effect corresponding to an average value of 3.1 is obtained in the case, in which the water supply unit is installed at the upper portion of the front side of the drum, whereas a crease removal effect corresponding to an average value of 3.2 is obtained in the case, in which the water supply unit is installed at the upper portion of the rear side of the drum. From the results of the test, accordingly, it can be seen that the case, in which the water supply unit is installed at the upper portion of the rear side of the drum, is more effective than the case, in which the water supply unit is installed at the upper portion of the front side of the drum, in terms of the crease removal effect.

It can also be seen that the case, in which the water supply unit is installed at the upper portion of the front side of the drum, exhibits a non-uniform degree of creases and a wide distribution of creases, as compared to the case, in which the water supply unit is installed at the upper portion of the rear side of the drum. This is because, when steam is sprayed from the water supply unit installed at the upper portion of the front side of the drum, the spray direction of the steam is substantially opposite to the flow path of air introduced into the drum at the rear side of the drum, and guided toward a region arranged beneath the door 104, so that the steam strikes the air, and is thus diffused in an increased extent toward the side and top of the drum. When the steam is diffused as described above, it cannot be uniformly attached to the clothes, so that the degree of creases of the clothes becomes non-uniform.

Hereinafter, the configuration for separably mounting the water supply unit 250 to the rear supporter 40 arranged at the rear side of the drum 20 will be described. The mounting of the water supply unit 250 can be achieved using various methods. Typically, a method using a flat head screw is used.

In this method, the water supply unit 250 is mounted at a desired position, using a flat head screw. However, this method has a problem in that a protruded portion of the flat head screw may damage the clothes received in the laundry dryer. That is, although the flat head screw has a flat head, it may be protruded even by a small degree. In particular, the protruded degree of the flat head screw may become severe after the laundry dryer is used for a prolonged period of time. Since the water supply unit is installed adjacent to the rotating drum, the clothes may be caught by the protruded portion of the screw while passing by the water supply unit during operation of the laundry dryer, so that the clothes may be damaged.

Where the flat head screw is used as described above, the mounting of the water supply unit is very inconvenient because it is necessary to fasten or unfasten the screw when it is desired to mount or separate the water supply unit.

To this end, the present invention provides a water supply unit, which can be easily mounted without incurring the above-mentioned problems. This will be described with reference to the accompanying drawings.

Figure 6:
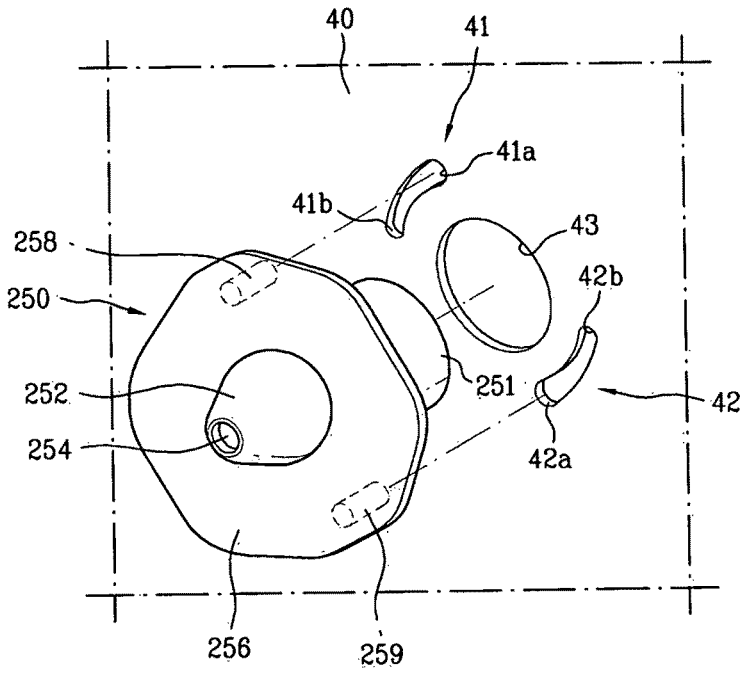
FIG. 6 is an enlarged perspective view illustrating a state in which a water supply unit according to a first embodiment of the present invention is separated from a rear supporter in the case of FIG. 4.

FIG. 6 is an enlarged perspective view illustrating a state in which a water supply unit 250 according to a first embodiment of the present invention is separated from the rear supporter 40.

Referring to FIG. 6, the water supply unit 250 according to this embodiment includes a nozzle 252 formed with an outlet 254 to spray steam, and a nozzle holder 256 extending from the nozzle 252. The nozzle holder 256 is separably mounted to the rear supporter 40. The nozzle holder 256 may be formed as a member separate from the nozzle 252. In this case, the nozzle holder 256 is connected to the nozzle 252. However, it is preferred that the nozzle holder 256 be integrated with the nozzle 256. In this case, it is possible to more easily mold the water supply unit 250.

Meanwhile, the nozzle holder 256 is provided with a coupler at a rear surface of the nozzle holder 256, to be separably mounted to the rear supporter 40. That is, in accordance with this embodiment, the coupler is provided at the rear surface of the nozzle holder 256, and the front surface of the nozzle holder 256 and the surface of the nozzle 252 are smooth. Accordingly, there is no coupler protruded from the front surface of the nozzle holder 256. In accordance with this structure, it is possible to prevent clothes, etc. from being damaged during operation of the laundry dryer.

The coupler provided at the rear surface of the nozzle holder 256 includes at least one coupling protrusion, for example, two coupling protrusions 258 and 259 in the illustrated case. Coupling slots 41 and 42 respectively corresponding to the coupling protrusions 258 and 259 are formed at desired portions of the rear supporter 40.

Preferably, the coupling slots 41 and 42 include respective reception portions 41*a* and 42*a* having a width allowing the coupling protrusions 258 and 259 to be inserted into the reception portions 41*a* and 42*a*, and respective holding portions 41*b* and 42*b* extending from the reception portions 41*a* and 42*a*, and functioning to hold the coupling protrusions 258 and 259. Each of the holding portions 41*b* and 42*b* has a width equal to or slightly smaller than that of the corresponding coupling protrusion 258 or 259, to firmly hold the corresponding coupling protrusion 258 or 259. That is, in accordance with this embodiment, each of the coupling slots 41 and 42 has a shape having a width gradually reduced as the coupling slot 41 or 42 extends from the corresponding reception portion 41*a* or 42*a* to the corresponding holding portion 41*b* or 42*b*. Meanwhile, it is preferred that the holding portions 41*b* and 42*b* be formed such that they form circular arcs oppositely arranged on the same circle, respectively, as shown in FIG. 6.

Hereinafter, the procedure for mounting the water supply unit 250 having the above-described configuration to the rear supporter 40 will be described. First, the operator inserts the coupling protrusions 258 and 259 of the water supply unit 250 into the reception portions 41*a* and 42*a* of the coupling slots 41 and 42 formed at the rear supporter 40, respectively. Thereafter, the operator rotates the water supply unit 250 in a direction toward the holding portions 41*b* and 42*b*, for example, in a counter-clockwise direction in FIG. 6. In this case, the coupling protrusions 258 and 259 are held by the holding portions 41*b* and 42*b* in a forcibly-fitted manner, respectively, because the holding portions 41*b* and 42*b* have a width equal to or slightly smaller than that of the coupling protrusions 258 and 259. The separation of the water supply unit 250 from the rear supporter 40 can be achieved in a manner reverse to the above-described procedure. Accordingly, no detailed description of the separation procedure will be given.

In FIG. 6, reference numeral "43" designates an opening formed through the rear supporter 40. A rear end 251 extending from the rear surface of the water supply unit 250 is connected to the steam generator 200 after extending through the opening 43.

Figure 7:
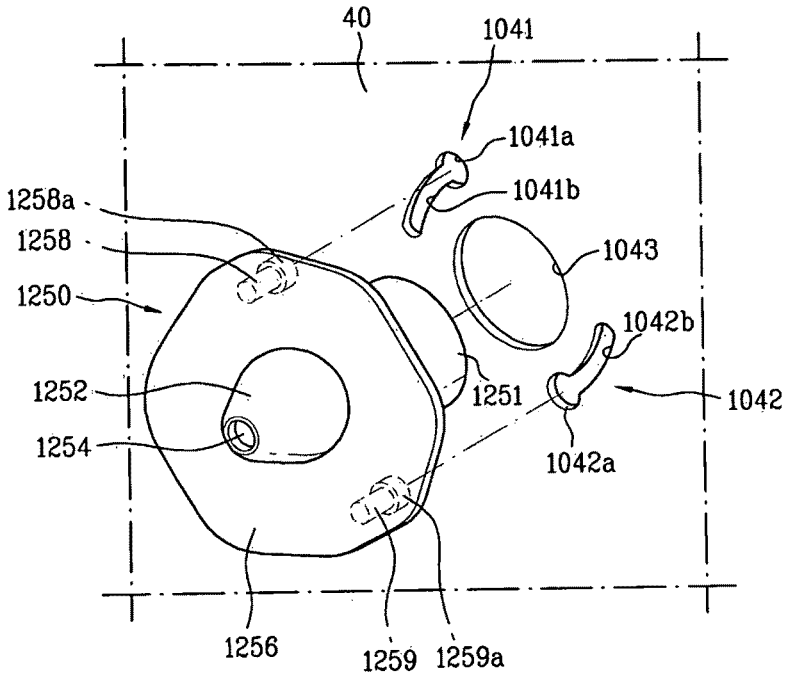
FIG. 7 is an enlarged perspective view illustrating a state in which a water supply unit according to a second embodiment of the present invention is separated from a rear supporter in the case of FIG. 4.

FIG. 7 is an exploded perspective view illustrating a state in which a water supply unit 1250 according to a second embodiment of the present invention is separated from the rear supporter 40. The water supply unit 1250 is different from that of the previous embodiment, in terms of the structure of the coupling protrusions and the structure of the coupling slots corresponding to respective coupling protrusions. The following description will be given, mainly in conjunction with this difference.

Referring to FIG. 7, the coupling protrusions 1258 and 1259 according to this embodiment include respective coupling portions 1258*a* and 1259*a* each formed at a free end of the corresponding coupling protrusion 1258 or 1259. Preferably, each of the coupling portions 1258*a* and 1259*a* has a diameter larger than those of other portions of the corresponding coupling protrusion 1258 or 1259. Meanwhile, it is preferred that the coupling slots 1041 and 1042 include respective reception portions 1041*a* and 1042*a* having a cross-sectional area corresponding to that of the coupling portions 1258*a* and 1259*a*, to allow the coupling portions 1258*a* and 1259*a* to be inserted into the reception portions 1041*a* and 1042*a*, and respective holding portions 1041*b* and 1042*b* extending from the reception portions 1041*a* and 1042*a*, and having a width equal to or slightly smaller than that of the coupling protrusions 1258 or 1259. Meanwhile, it is preferred that the holding portions 1041*b* and 1042*b* be formed such that they form circular arcs oppositely arranged on the same circle, respectively, as shown in FIG. 7.

Hereinafter, the procedure for mounting the water supply unit 1250 having the above-described configuration to the rear supporter 40 will be described. First, the operator inserts the coupling portions 1258*a* and 1259*a* of the coupling protrusions 258 and 259 included in the water supply unit 1250 into the reception portions 1041*a* and 1042*a* of the coupling slots 1041 and 1042 formed at the rear supporter 40, respectively. Thereafter, the operator rotates the water supply unit 1250 in a direction toward the holding portions 1041*b* and 1042*b*, namely, in a counter-clockwise direction. In this case, the coupling protrusions 1258 and 1259 are held by the holding portions 1041*b* and 1042*b* in a forcibly-fitted manner, respectively, because the holding portions 1041*b* and 1042*b* have a width equal to or slightly smaller than that of the coupling protrusions 1258 and 1259. In accordance with this embodiment, the coupling protrusions 1258 and 1259 are prevented from being separated from the holding portions 1041*b* and 1042*b* of the coupling slots 1041 and 1042 by the coupling portions 1258*a* and 1259*a* formed at the free ends of the coupling protrusions 1258 and 1259, respectively. The separation of the water supply unit 1250 from the rear supporter 40 can be achieved in a manner reverse to the above-described procedure. Accordingly, no detailed description of the separation procedure will be given.

Figure 8:
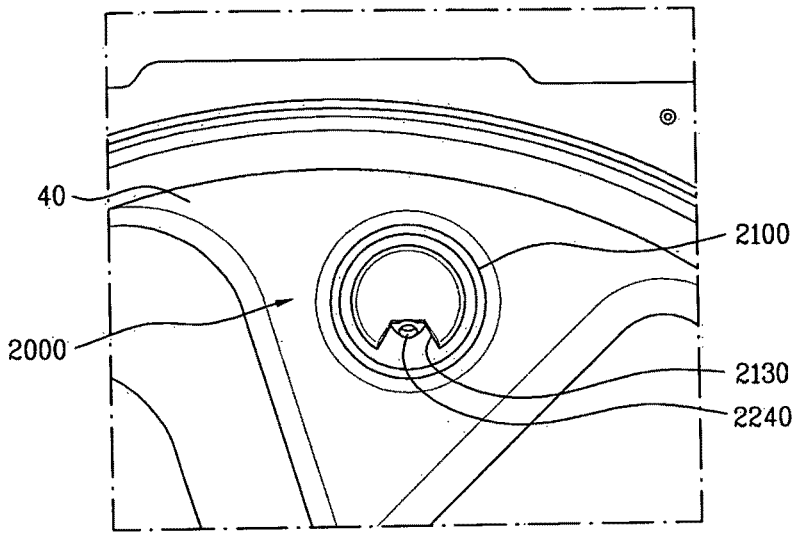
FIG. 8 is a front view illustrating a state in which a water supply unit according to a third embodiment of the present invention is mounted to the rear supporter in the case of FIG. 4.
Figure 9:
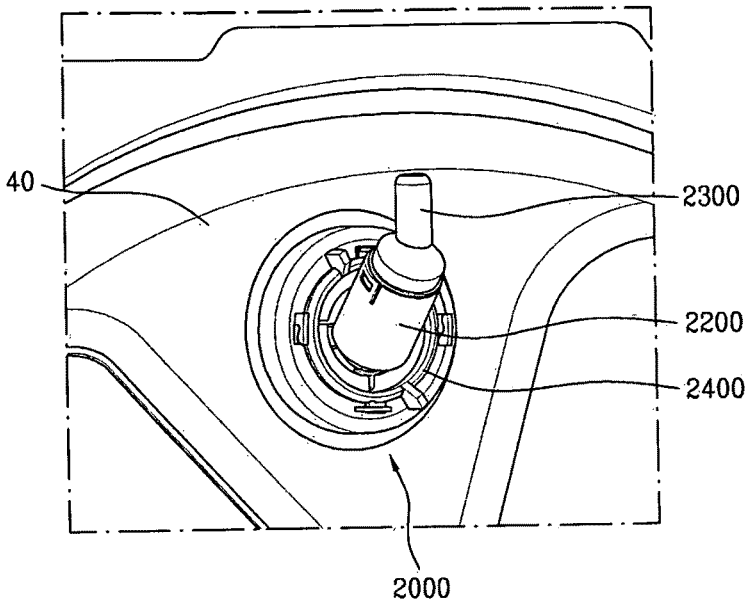
FIG. 9 is a rear perspective view illustrating a state in which the water supply unit of FIG. 8 is mounted to the rear supporter.

FIG. 8 is a front view illustrating a state in which a water supply unit 2000 according to a third embodiment of the present invention is mounted to the rear supporter 40. FIG. 9 is a rear perspective view illustrating a state in which the water supply unit 2000 according to the embodiment of FIG. 8 is mounted to the rear supporter 40.

Referring to FIGS. 8 and 9, the water supply unit 2000 according to this embodiment includes a nozzle 2200 for spraying steam, a front cover 2100 forming a nozzle holder, to which the nozzle 220 is separably mounted, and a ring member 2400 forming a coupler to mount the nozzle 2200 to the front cover 2100.

Preferably, the front cover 2100 is arranged at an upper portion of the rear supporter 40. In detail, although not shown, the front cover 2100 is fitted in an opening formed through the rear supporter 40.

Figure 11:
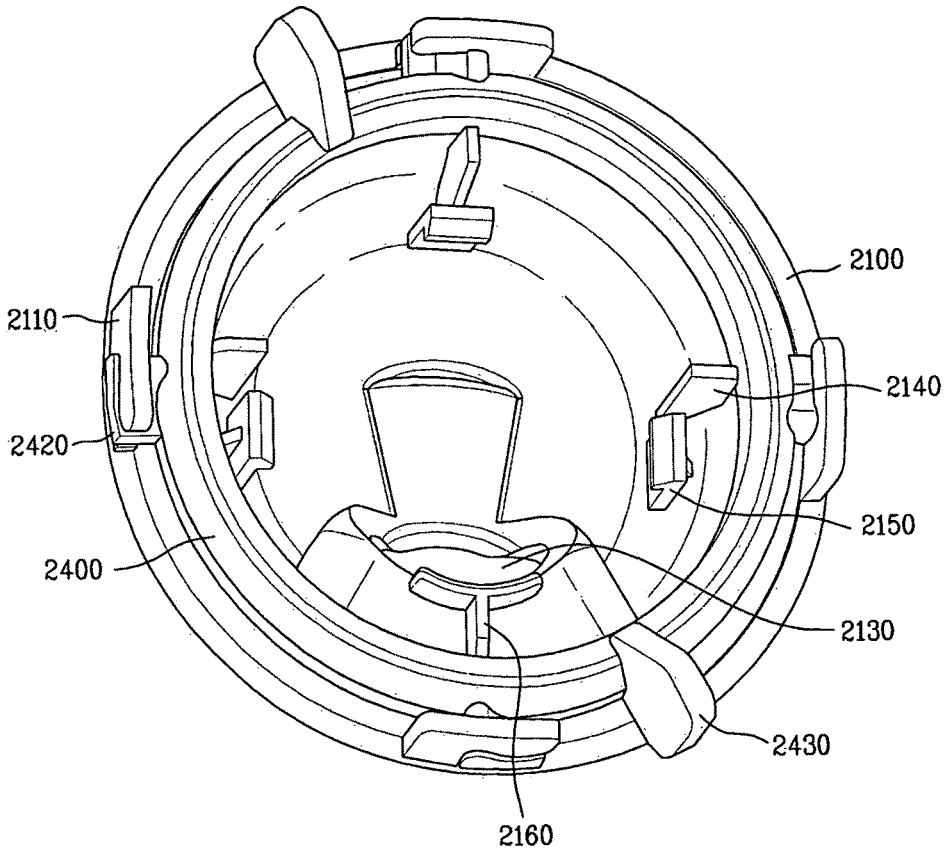
FIG. 11 is a perspective view illustrating a state in which a front cover is coupled to a ring member in the case of FIG. 10, without illustrating the rear supporter and a nozzle, for the convenience of description.

Meanwhile, the front cover 2100 has a smooth front surface. An opening 2130 is formed through the front cover 2100 at a lower portion of the front cover 2100. The nozzle 2200 sprays steam into the drum ("20" in FIG. 1) through the opening 2130. Since the water supply unit 2000 is arranged at the upper portion of the rear supporter 40, it is preferred that the opening 2130 be formed such that it is downwardly opened, as shown in FIG. 11. In accordance with this structure, steam emerging from the water supply unit 2000 is directed to the central portion of the drum ("20" in FIG. 1).

In accordance with this embodiment, the nozzle 2200 is mounted to a rear surface of the front cover 2100. Steam emerging from an outlet 2240 of the nozzle 2200 is supplied to the drum 20 through the opening 2130 of the front cover 2100. Thus, in accordance with this embodiment, the front end of the nozzle 2200, at which the outlet 2240 is formed, is not protruded from the front surface of the front cover 2100. In accordance with this structure, it is possible to prevent objects to be dried from being caught by the nozzle 2200 during rotation of the drum 20 according to an operation of the laundry dryer, and thus to prevent the object from being damaged by the nozzle 2200.

In FIG. 9, reference numeral "2300" designates a connector connected to the rear end of the nozzle 2200. The connector 2300 will be described in detail later.

Hereinafter, the coupling between the front cover 2100 and the nozzle 2200 will be described in detail with reference to the accompanying drawings.

Figure 10:
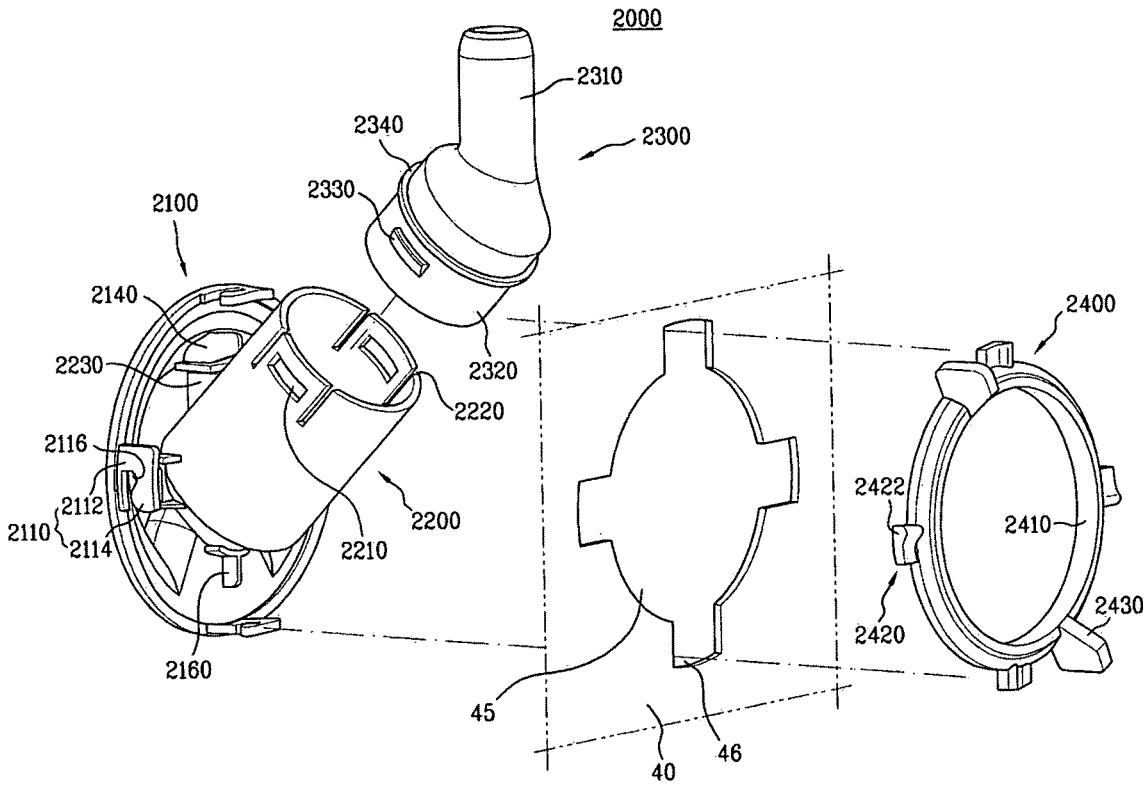
FIG. 10 is an exploded perspective view illustrating an exploded state of the water supply unit of FIG. 8.

FIG. 10 is an exploded perspective view illustrating an exploded state of the water supply unit according to this embodiment.

Referring to FIG. 10, as described above, the water supply unit 200 according to this embodiment includes the front cover 2100, which is separably mounted to the rear supporter ("40" in FIG. 8), the nozzle 2200 separably mounted to the rear surface of the front cover 2100, and the ring member 2400 for mounting the nozzle 2200 and front cover 2100.

As described above, the front cover 2100 is fitted in the opening (not shown) formed through the upper portion of the rear supporter 40. In detail, the front cover 2100 has a circular plate shape, and is formed with a downwardly-directed opening ("2130" in FIG. 8), as described above. Steam from the nozzle 2200 is supplied to the interior of the drum 20 through the opening 2130, as described above.

Meanwhile, at least one first engagement member 2110 is protruded from the rear surface of the front cover 2100. The ring member 2400 is provided with a second engagement member 2420 corresponding to the engagement member 2110. When the front cover 2100 is mounted to the rear supporter 40, the first engagement member 2110 of the front cover 2100 is protruded from the rear surface of the rear supporter 40 in a rearward direction, so that it can be engaged with the second engagement member 2420 of the ring member 2400, thereby causing the front cover 2100 to be mounted to the rear supporter 40 via the ring member 2400. At this time, the rear supporter 40 is interposed between the front cover 2100 and the ring member 2400.

Preferably, one or more first engagement members 2110 are formed along the peripheral edge of the front cover 2100 at the rear surface of the front cover 2100. In this embodiment, four first engagement members 2110 are formed along the peripheral edge of the front cover 2100 at the rear surface of the front cover 2100 while being uniformly spaced apart from one another by an angle of 90°. However, the present invention is not limited to such an arrangement. In detail, each first engagement member 2110 includes a vertical portion 2112 extending vertically from the rear surface of the front cover 2100, and an extension portion 2114 extending from the vertical portion 2112 to form an engagement groove 2116.

Meanwhile, the ring member 2400 includes an annular body 2410 corresponding to the circular shape of the front cover 2100, and second engagement members 2420 formed along the body 2410 such that they correspond to the first engagement members 2110 of the front cover 2100, respectively. The body 2410 has an annular shape substantially corresponding to the front cover 2100. Each second engagement member 2420 includes a protrusion 2422, which can be engaged with the engagement groove 2116 of the corresponding engagement member 2110. Preferably, at least one rotating bar 2430 is formed at the body 2410, to allow the operator to rotate the ring member 2400. As will be described later, each second engagement member 2420 of the ring member 2400 is engaged with the corresponding first engagement member 2110 of the front cover 2100 as the ring member 2400 rotates with respect to the front cover 2100. Accordingly, it is preferred that the rotating bar 2430 be provided at the ring member 2400, to rotate the ring member 2400.

When the front cover 2400 is inserted into the opening of the rear supporter 40 from the front side of the rear supporter 40, each first engagement member 2110 of the front cover 2400 extends through the opening of the rear supporter 40 such that it is protruded from the rear surface of the rear supporter 40 in a rearward direction. That is, the opening of the rear supporter 40 has a size smaller than that of the front cover 2100, and is formed with a groove (not shown) at a position corresponding to each engagement member 2110, to allow the first engagement member 2110 to be protruded from the rear surface of the rear supporter 40 in a rearward direction.

After each first engagement member 2110 of the front cover 2100 is protruded from the rear surface of the rear supporter 40 in a rearward direction, as described above, the operator brings the ring member 2400 into contact with the rear supporter 40, and then rotates the ring member 2400 by a certain angle, for example, in a clockwise direction in FIG. 10, using the rotating bar 2430. In accordance with this rotation, the protrusion 2422 of each second engagement member 2420 is engaged with the engagement groove 2116 of the corresponding engagement member 2110, so that the front cover 2110 is coupled with the ring member 2400. Thus, the front cover 2110 is firmly mounted to the rear supporter 40 by the ring member 2400.

FIG. 11 illustrates a state in which each first engagement member 2110 is engaged with the corresponding second engagement member 2420 in accordance with the rotation of the ring member 2400, as described above. In FIG. 11, the rear supporter 40 and nozzle 2200 are not shown, for the convenience of description.

Referring to FIG. 11, it can be seen that each second engagement member 2420 of the ring member 2400 is firmly engaged with the engagement groove 2116 of the corresponding first engagement member 2110 of the front cover 2100 as the ring member 2400 rotates in the clockwise direction. Thus, the front cover 2100 is mounted to the rear supporter 40 by the ring member 2400 in a state in which the rear supporter 40 is interposed between the front cover 2100 and the ring member 2400.

On the other hand, when it is desired to separate the front cover 2100, the operator rotates the ring member 2400 in the counter-clockwise direction. That is, the operator applies a counter-clockwise force to the rotating bar 2430 of the ring member 2400, to cause each second engagement member 2420 of the ring member 2400 from being disengaged from the engagement groove 2116 of the corresponding first engagement member 2110 of the front cover 2100. Thus, it is possible to separate the ring member 2400. After the separation of the ring member 2400, the operator can separate the front cover 2100 from the front side of the rear supporter 40.

Meanwhile, it is preferred that at least one guide member 2140 is formed at the rear surface of the front cover 2100, to guide the rotation of the ring member 2400 while preventing a rolling of the ring member 2400 during the coupling of the ring member 2400. In detail, the guide member 2140 is formed at the rear surface of the front cover 2100 such that it defines an inscribed circle having a diameter equal to the inner diameter of the ring member 2400. That is, one or more guide members 2140 are formed such that an inscribed circle defined along the outer side surfaces of the guide members 2140 conforms to the inner circumferential surface of the ring member 2400. Where the guide members 2140 are arranged in the above-described manner, the coupling between the front cover 2100 and the ring member 2400 can be achieved by first fitting the guide members 2140 in the ring member 2400 along the inner periphery of the ring member 2400, and then rotating the ring member 2400.

Referring to FIGS. 10 and 11, the nozzle 220 is separably mounted to the rear surface of the front cover 2100.

In detail, at least one engagement jaw 2150 is formed at the rear surface of the front cover 2100. An engagement bar 2230 corresponding to the engagement jaw 2150 is formed at the nozzle 2200. When it is desired to mount the nozzle 2200 to the front cover 2100, the operator engages the engagement bar 2230 with the engagement jaw 2150 of the front cover 2100. Where the nozzle 220 is mounted as described above, it is preferred that at least one support member 2160 for supporting the nozzle 2200 be provided at the rear surface of the front cover 2100. The support member 2160 firmly supports the nozzle 2200 when the nozzle 2200 is mounted to the front cover 2100, in order to prevent the nozzle 2200 from drooping downwardly.

Preferably, the nozzle 2200 is arranged to be inclined by a certain angle with respect to the front cover 2100, in order to spray steam toward the central portion of the drum 20. Accordingly, the engagement bar 2230 is formed at the nozzle 2200, taking into consideration the inclination of the nozzle 2200. For example, where three engagement jaws 2150 are formed at the rear surface of the front cover 2100, as shown in FIG. 14, the engagement bar 2230, which will be engaged with an upper one of the engagement jaws 2150 may have a length longer than that of the remaining engagement bars 2230, which will be engaged with the lower engagement jaws 2150. In accordance with this structure, it is possible to install the nozzle 2200 in a state of being inclined by a certain angle.

An outlet ("2240" in FIG. 8) is formed at the front end of the nozzle 2200, to discharge steam. Preferably, the rear end of the nozzle 2200 is connected with the connector 2300, which is connected to the steam generator ("200" in FIG. 3), to supply steam to the water supply unit 2000.

In this case, the connector 2300 can be mounted to the rear end of the nozzle 2200 in a fitted manner. In detail, the connector 2300 includes an upper body 2310 connected to the steam generator 200, and a lower body 2320 fitted in the nozzle 2200. The upper body 2310 is connected to the steam generator 200 by a pipe (not shown) or the like. The lower body 2320 is connected to the nozzle 2200 as it is fitted in the nozzle 2200. As shown in FIG. 10, the upper and lower bodies 2310 and 2320 may be formed to be bent with respect to each other. This is because it is preferred that, since the nozzle 2200 is installed to form a certain angle with respect to the rear surface of the front cover 2100 such that the nozzle 2200 is directed toward the central portion of the drum 20, the lower body 2320 of the connector 2300 should be connected to the nozzle 2200 in parallel to the nozzle 2200, and the upper body 2310 should be formed to extend in a direction normal to the ground, taking into consideration the connection thereof with the steam generator 200.

At least one engagement protrusion 2330 is formed at the lower body 2320 of the connector 2300. Also, at least one engagement hole 2210 corresponding to the at least one engagement protrusion 2330 is formed through the nozzle 2200 at a position adjacent to the rear end of the nozzle 2200. When the operator inserts the lower body 2320 into the rear end of the nozzle 2200, the engagement protrusion 2330 of the connector 2300 is engaged with the engagement hole 2210. Thus, the connector 2300 can be firmly fitted to the nozzle 2200.

If the lower body 2320 of the connector 2300 has a diameter larger than that of the rear end of the nozzle 2200 even in a slight extent, it is difficult or impossible to fit the lower body 2320 in the rear end of the nozzle 2200. To this end, in this embodiment, it is preferred that at least one slit 2220 be provided to allow the connector 2300 to be easily fitted in the rear end of the nozzle 2200. The slit 2220 extends from the rear end of the nozzle 2200 by a certain length.

Accordingly, when the connector 2300 is inserted into the rear end of the nozzle 2200, the rear end of the nozzle 2200 can be elastically widened by the slit 2220. As a result, even when the lower body 2320 of the connector 2300 has a diameter larger than that of the rear end of the nozzle 2200, it is possible to connect the connector 2300 to the nozzle 2200.

Meanwhile, there is no limitation in the materials of the front cover 2100, nozzle 2200, connector 2300, and ring member 2400. However, these elements may be made of a synthetic resin. Preferably, these elements are made of a synthetic resin having elasticity.

Preferably, an annular stopper 2340 is formed between the upper and lower bodies 2310 and 2320 of the connector 2300, along the outer periphery of the connector 2300. The stopper 2340 is protruded from the outer periphery of the connector 2300 along the outer periphery at a position spaced apart from a lower end of the lower body 2320 by a certain distance. In accordance with the provision of the stopper 2340, it is possible to prevent the connector 2300 from being inserted into the rear end of the nozzle 2200 in excess of a desired length, even when the engagement protrusions 2330 of the connector 2300 are engaged with the engagement holes 2210 of the nozzle 2200.

Meanwhile, the water supply unit described in this embodiment is applicable to laundry dryers other than the laundry dryer equipped with the detachable water supply source 300. For example, the water supply unit is applicable to the case in which a fixed water supply source or an external city water tap is used.

Based on the results of the test, it can be seen that the present invention provides crease removal and prevention effects, even though there is a variation in the removal and prevention effects depending on the kind of clothes and the moisture absorption degree of clothes. Objects to be dried may include even the laundry, which has been completely spin-dried, without being limited thereto. For example, if clothes worn for about one day, namely, clothes completely dried while having a small amount of creases, can be processed in the laundry dryer according to the present invention, to remove creases, particular usefulness may be provided in this case. That is, the laundry dryer according to the present invention can be used for a crease removal apparatus.

As apparent from the above description, the laundry dryer according to the present invention provides the following effects.

First, in accordance with the present invention, there are advantages in that it is possible to effectively prevent the formation of creases or rumples on completely-dried objects, and to effectively remove the formed creases or rumples. In accordance with the present invention, there is also an advantage in that it is possible to sterilize objects to be dried, and to remove odor from the objects.

Second, in accordance with the present invention, there is an advantage in that it is possible to effectively remove creases present on objects, which are in a dried state, without performing ironing.

Third, in accordance with the present invention, it is possible to spray steam onto clothes such that the steam is uniformly attached to the clothes, and thus to more effectively remove creases present on the clothes.

Fourth, in accordance with the present invention, the mounting or separation of a nozzle for spraying steam can be more easily achieved.

Fifth, in accordance with the present invention, the nozzle can be mounted in a fitting manner. Accordingly, damage to clothes can be reduced, as compared to the case in which the nozzle is mounted, using a fastening member such as a bolt.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A washing machine comprising:

a drum rotatably installed in a cabinet;

an air heater for heating air, to supply hot air to the drum;

a water generator for generating water, and supplying the water to the drum; and a water supply unit comprising a nozzle for spraying the water generated by the water generator to an interior of the drum, and a nozzle holder having a coupler at a rear surface of the nozzle holder, to separably mount the nozzle at a position adjacent to the drum, wherein:

the water supply unit is separably mounted to a rear supporter arranged at a rear surface of the drum;

the nozzle holder comprises a front cover separably mounted to the rear supporter, the front cover holding the nozzle such that the nozzle is separable from the front cover; and the coupler comprises a ring member coupled to a rear surface of the front cover under a condition in which the rear supporter is interposed between the front cover and the ring member, and at least one first engagement member formed at the rear surface of the front cover such that the first engagement member can be engaged with the ring member.

2. The washing machine according to claim 1, wherein the front cover is formed with an opening, through which the nozzle sprays steam into the drum, under a condition in which the nozzle is not protruded from a front surface of the front cover.

3. The washing machine according to claim 2, wherein:

the water supply unit is arranged at an upper portion of the rear supporter; and the opening is opened to be directed in a downward direction.

4. The washing machine according to claim 2, wherein the front cover is provided with at least one engagement jaw arranged at the rear surface of the front cover, to separably hold the nozzle.

5. The washing machine according to claim 4, wherein the front cover is provided with at least one support member arranged at the rear surface of the front cover, to support the nozzle.

6. The washing machine according to claim 1, wherein the front cover is provided with at least one guide member arranged at the rear surface of the front cover, to guide a movement of the ring member while preventing a rolling of the ring member when the ring member moves to be engaged with the first engagement member of the front cover.

7. The washing machine according to claim 1, wherein the ring member comprises:

an annular body; and at least one second engagement member arranged on the body, to be engaged with the at least one first engagement member.

8. The washing machine according to claim 7, wherein the ring member rotates by a predetermined angle such that the second engagement member is engaged with the first engagement member.

9. The washing machine according to claim 8, wherein the ring member further comprises:

at least one rotating bar formed at the body of the ring member, to rotate the ring member.

10. The washing machine according to claim 1, wherein the water supply unit further comprises:

a connector separably connected to a rear end of the nozzle, to connect the nozzle to the steam generator.

11. The washing machine according to claim 10, wherein:

the connector is provided with at least one engagement protrusion; and the nozzle is provided with at least one engagement hole formed at the rear end of the nozzle, to be engaged with the at least one engagement protrusion.

12. The washing machine according to claim 11, wherein the nozzle is provided with at least one slit extending from the rear end of the nozzle in a longitudinal direction of the nozzle by a predetermined length.

13. The washing machine according to claim 11, wherein the connector is provided with a stopper to set a relative position between the connector and the nozzle when the connector is connected to the rear end of the nozzle.

* * * * *